United States Patent [19]

Johnson

[11] Patent Number: 4,457,260

[45] Date of Patent: Jul. 3, 1984

[54] SEALANT APPLICATOR FOR MULTI-LENGTH FASTENERS

[75] Inventor: George W. Johnson, Smyrna, Ga.

[73] Assignee: Lockheed Corporation, Burbank, Calif.

[21] Appl. No.: 465,096

[22] Filed: Feb. 9, 1983

[51] Int. Cl.[3] ..... B05C 9/02

[52] U.S. Cl. ..... 118/711; 118/410

[58] Field of Search ..... 118/710, 711, 410; 10/10 P

[56] References Cited

U.S. PATENT DOCUMENTS 4,359,965 11/1982 Bridges, Sr. ..... 118/711

*Primary Examiner*—Michael R. Lusignan
*Assistant Examiner*—K. E. Jaconetty
*Attorney, Agent, or Firm*—John J. Sullivan

[57] ABSTRACT

A sealant applicator assembly (20) for mounting to an automatic drilling and fastener installation machine to apply sealant to the tip or shank surfaces of varying grip-length fasteners (24,53) before "wet" installation of the fastener into a hole. The assembly includes a pair of valve members (32,35) controlling the flow of sealant into contact with the fastener shank: one valve member (32) being opened or actuated by physical engagement between the valve member and the fastener tip when the shank length of the fastener being installed is sufficient to engage the valve member; and a second valve member (35) being opened or actuated by engagement of means (52) on the fastener installation machine when the shank length of the fastener being installed is insufficient to permit physical engagement between the fastener tip and the first valve member.

4 Claims, 7 Drawing Figures

SEALANT APPLICATOR FOR MULTI-LENGTH FASTENERS

TECHNICAL FIELD

This invention pertains to a liquid or sealant applicator for use on automatic drilling and fastener installation machines, and more particularly to an apparatus for applying a liquid or sealant to the axial side surfaces or tips of fasteners with varying or different shank lengths before installation thereof.

BACKGROUND ART

In Bridges U.S. Pat. No. 4,359,965, issued Nov. 23, 1982 and assigned to the same assignee as this invention, there is provided an arrangement for applying sealant to the tips or sidewalls of a fastener for "wet" installation thereof. It is inherent in the Bridges arrangement that the shank length of the fastener must be sufficiently long enough to permit the physical engagement between the fastener tip and the valve member for actuation or opening thereof. Thusly, once the Bridges sealant applicator is set-up on the fastener installation machine, the sealant applicator is workable so long as the shank length of the fasteners being installed is sufficient to actuate the valve in the sealant applicator. If installation of an intermittent or series of fasteners with insufficient shank lengths is required, any sealant application required necessitates hand application or a replacement of one size of the Bridges device for another sized unit through an additional machine set-up: either of which is time consuming resulting in a decrease of machine efficiency and quantity/time installation of fasteners.

DISCLOSURE OF THE INVENTION

This invention provides an apparatus that combines the prior art Bridges arrangement with a second valving and actuation arrangement that is mountable on an automatic fastener installation machine whereby a protective fluid or sealant material is deposited directly on the tip or shank portions of multi-length fasteners before the insertion of the fasteners into a preprepared hole. By being able to provide for deposition of protective fluids or sealants on fasteners having shank lengths insufficient to operate the sealant flow control valve of the prior art, such deposition on the shorter shank fasteners can occur without interference of machine cycle time that would be occasioned by hand application of sealant, or the change of machine set-up with a different sized applicator and subsequent re-operation of the machine.

Other objects and advantages are presented with the apparatus of this invention in that there is no added complexity to the machine cycle inasmuch as sealant is applied to the shorter shank fasteners at the same machine station for sealant application to the longer shank fasteners, and there is only one additional moving part required in this improved apparatus so that the easy cleaning attribute of the prior art apparatus is maintained despite a substantial increase in flexibility and utilization thereover.

DETAILED DESCRIPTION

Figure 3:
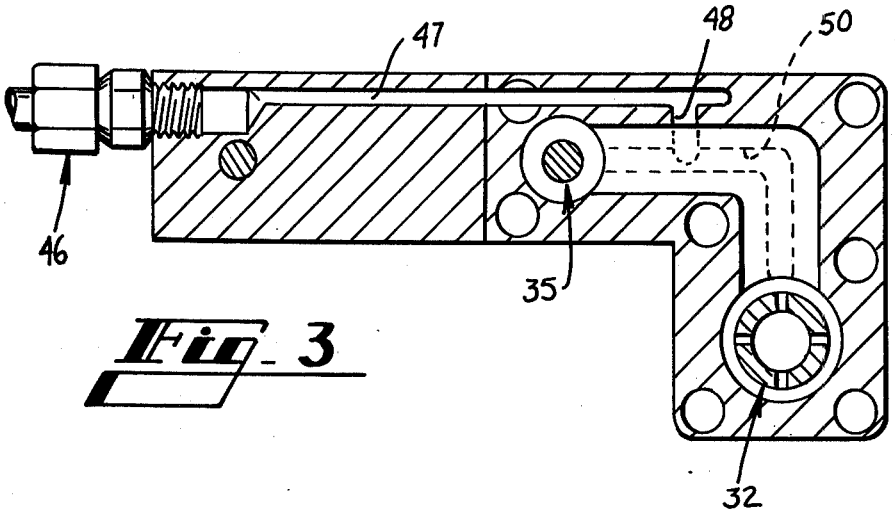
FIG. 3 is a plan-wise, cross-sectional view of the preferred embodiment of this invention.
Figure 1:
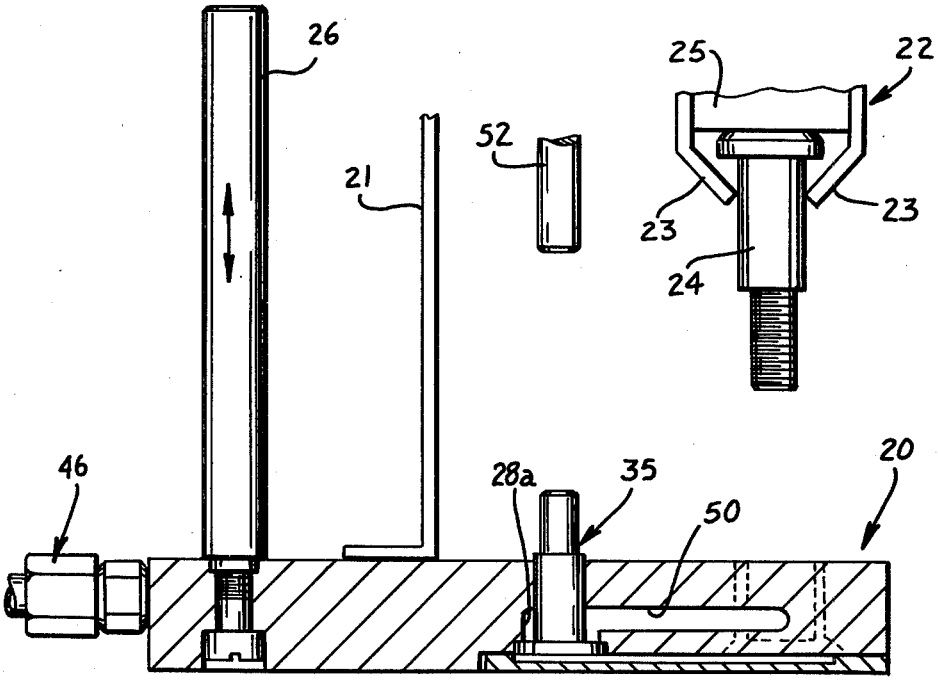
FIG. 1 shows the relative physical locations of the preferred embodiment apparatus of this invention and a typical fastener holding and installation member of an automatic fastener installation machine.
Figure 2:
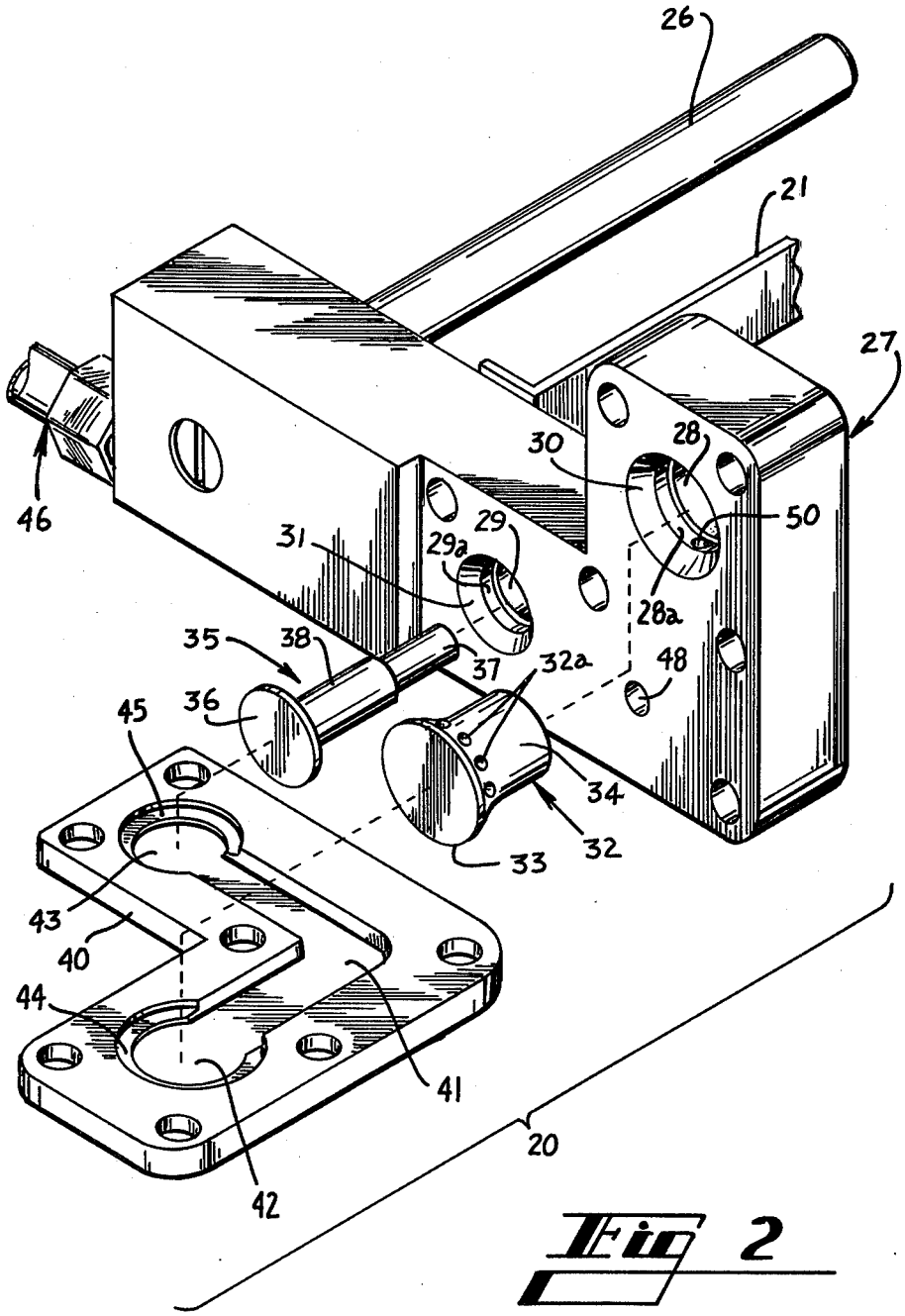
FIG. 2 is an exploded view of the preferred embodiment of this invention.

Referring to FIGS. 1, 2 and 3, the preferred embodiment of this invention comprises a sealant applicator assembly 20 connected to a movable mount 21 such as can be located on an automatic fastener installation machine (not shown). Such mount 21 is movable relative to an appropriate fastener gripping and installation driving mechanism 22 shown consisting of fingers 23 gripping a threaded fastener 24 with the head of said fastener located in abutment with fastener installing or driving ram 25. The mount 21 and mechanism 22 as shown are respresentative of segments of an automatic fastener installation machine and are individually and selectively movable in any combination of X,Y, or Z-axis directions; all of which form no part of this invention other than the requirement that there be some relative vertical movement between mount 21 and mechanism 22 as represented by the bi-directional arrow placed on a vertical guide 26 secured to assembly 20 and engageable with the automatic fastener installation machine for controlled relative movement with mechanism 22 in a slideable guiding manner; such relative vertical movement between mount 21 and mechanism 22 as discussed in the explanation of operation of the invention hereinafter.

The assembly 20 comprises a body 27 having a pair of vertical passages 28 and 29, the bottoms of which are countersunk to form truncated conical surfaces 30 and 31 with each having an intermediate counterbore **28*a* and 29*a*** respectively.

A valve body or sealant dispensing cup 32 of a substantially calathiform shape with a plurality of holes **32*a* extending through the sidewall of tubular portion 34 for communication between the interior and exterior of cup 32 proximate an enlarged base portion 33 is inserted into passage 28 and is diametrically sized along the main tubular portion 34 to permit a slideable engagement with the sidewall of passage 28. The diameter of base portion 33 is sized to seat on surface 30 when cup 32 is inserted into passage 28** the maximum amount possible.

A second valve body 35 with an enlarged base portion 36 and an extended shank portion 37 is inserted into passage 29 and is diametrically sized along the main shank portion 38 to permit a slideable engagement with the sidewall of passage 29. The diameter of base portion 36 is sized to seat on surface 31 when valve body 35 is inserted into passage 29 the maximum amount possible.

A closure or base member 40 is secured to the bottom of body 27 by appropriate fastening devices such as screws (not shown). The surface of member 40 confronting body 27 when assembled thereto contains a right-angled channel arrangement 41 which is enlarged at both ends to form in plan view the appearance of a key hole 42 and 43. The enlarged end 42 of channel 41 is further enlarged to provide a semiannular step or ledge 44, and the enlarged end 43 of channel 41 is further enlarged to provide a semiannular step or ledge 45.

The extent of channel 41 and enlargements are such that the smaller of the enlargements forming keyhole segment 42 is less than the diameter of base portion 33 of valve body 32 and the diameter of step or ledge 44 is greater than the diameter of base portion 33 so that valve body 32 can move in passage 28 between an open position with base portion 33 seated on ledge 44 and a closed position when valve 32 is located within passage 28 the maximum extent possible to seat base portion 33 on conical surface 30. At the other end of channel 41, the smaller of the enlargements forming keyhole segment 43 is less than the diameter of base portion 36 of valve body 35 and the diameter of step or ledge 45 is greater than the diameter of base portion 36 so that valve 35 can move in passage 29 between an open position with base portion 36 seated on ledge 45 and a closed position when valve 35 is located within passage 29 the maximum extent to seat base portion 36 on conical surface 31.

A pressurized liquid or sealant supply line 46 is connected to body 27 at the external end of a first supply passage 47 into body 27 to a second supply passage 48 that extends from the first supply passage 47 to the bottom of body 27 for communication with channel 41 of base member 40 as best seen in FIGS. 2 and 3.

Body 27 contains further passage means 50 that interconnects counterbores **28*a* and 29*a*; this interconnecting passage 50 partially shows in solid lines in FIG. 1 and by dotted lines in FIG. 3**.

A vertically adjustable stop member 52 as seen in FIG. 1 is located on the automatic fastening installation machine (not shown) with an X- and Y- axes relationship relative to the installation driving mechanism 22 so as to locate stop member 52 in coaxial alignment with valve 35 when installation drive mechanism 22 is coaxially aligned with valve 32 for purposes that will be explained below in the operation of this invention.

OPERATION OF THE INVENTION

Referring to FIGS. 1,4,5,6 and 7, applicator assembly 20 is connected to machine mount 21 and the sealant supply line 46 is connected to body 27 whereby sealant from the supply line 46 under pressure flows through the first and second supply passages 47 and 48 (FIG. 3) into channel 41 (FIG. 2) and causes valve bodies 32 and 35 to move upwardly in their respective vertical passages 28 and 29 and thereby prevent further sealant flow due to the sealing actions of base portions 33 and 36 both being held in contact with their respective chamfered surfaces 30 of passage 28 and 31 of passage 29.

Figure 4:
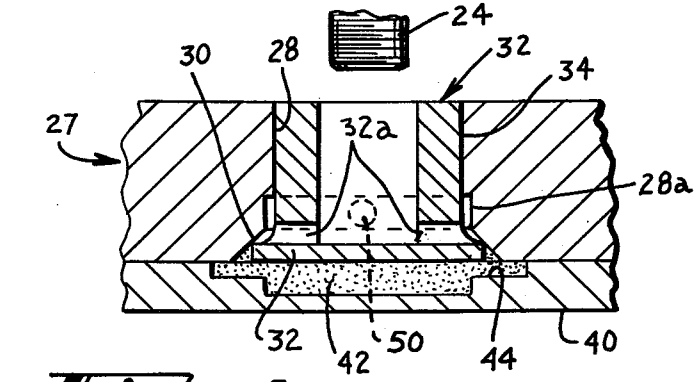
FIGS. 4 and 5 are cross-sectional views of one of the control valves and its nearby environs associated with application of sealant to fasteners of sufficient grip lengths to actuate the valve, said valve being shown in the closed position in FIG. 4 and in the open position in FIG. 5; and, FIGS. 6 and 7 are cross-sectional views of the control valves and their nearby environs associated with application of sealant to fasteners of insufficient grip length to actuate the valve of FIGS. 4 and 5, the valve in FIG. 6 being in the closed position and the valve in FIG. 7 being in the open position.
Figure 5:
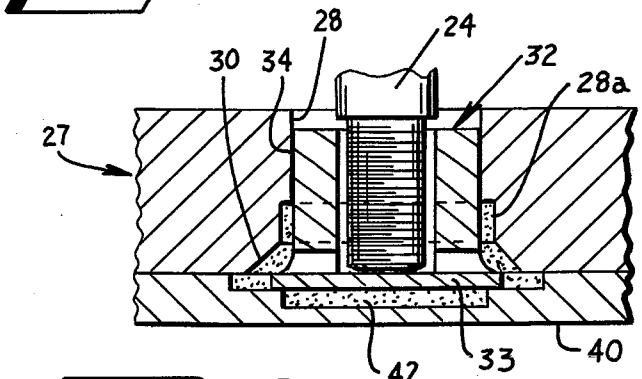

As the fastener installation mechanism 22 and mount 21 are moved relative to each other so that the fastener 24 is aligned with the interior of the valve or sealant dispensing cup 32 as shown in FIG. 4, the final action for application of sealant to fastener 24 is accomplished by a relative vertical motion between mount 21 and mechanism 22 toward each other as represented by the arrow on vertical guide 26. In the case of where the grip-length of fastener 24 is greater than the depth of valve cup 32, such relative vertical motion places the tip end of fastener 24 onto the bottom of the interior of valve cup 32 forcing the cup 32 down in passage 28 until base 33 rests on step or ledge 44 as seen in FIG. 5 whereby the sealant flows from channel 41 through holes **32*a* into the annular space between the interior sidewall of cup 32 and the exterior surface of fastener 24 for coating contact therewith. After sealant application, the fastener 24 is withdrawn from cup 32, the cup 32 is raised from the open position in FIG. 5 to the closed position in FIG. 4 by the presence of sealant in channel 41 and channel portion 42 reacting on the bottom of base 33**.

Figure 6:
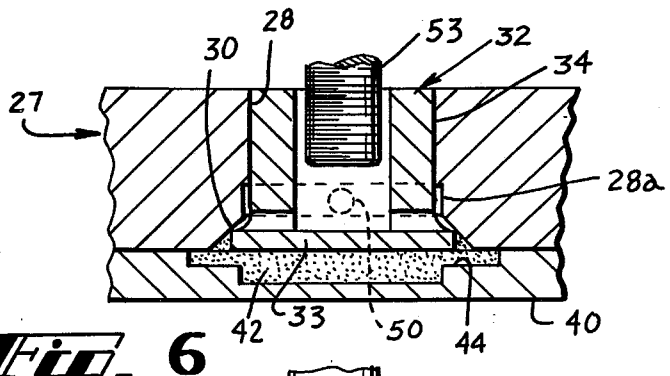
Figure 7:
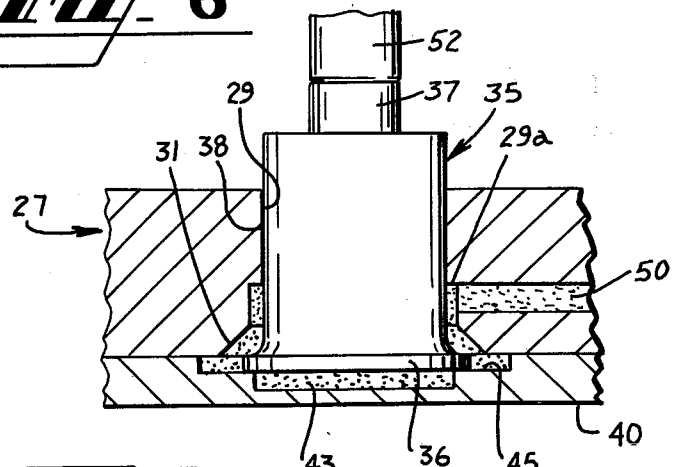

In the case of sealant application to a fastener of insufficient grip-length to contact the interior bottom of valve cup 32, such as in the case of a short fastener 53 shown in FIG. 6 shown in its maximum insertion depth into valve cup 32 for sealant application, the operation of the second valve 35 takes place for sealant application to the short fastener 53. In FIGS. 6 and 7, the fastener 53 is of such a short grip-length that when it reaches the proximate maximum level of insertion into valve cup 32, the adjustable stop 52 has contacted the extended portion 37 of valve 35 and moved its base portion 36 into contact with ledge 45 whereby valve 35 is now open. The sealant flow path from supply 46 to the interior of cup 32 is through first and second supply passages 47,48, channel 41, the annulus formed between valve 35 and conical surface 31, counterbore **29*a*, interconnecting passage 50, the annulus formed by the counterbore 28*a* with valve 32 and conical surface 30, and finally through holes 32*a* into the interior of valve cup 32, with valve 32 remaining in its closed position as shown in FIG. 6**.

After sealant application, the fastener 53 is drawn from cup 32 as stop 52 is withdrawn from valve 35, and valve 35 is raised from its open position shown in FIG. 7 to a closed position with base 36 seating on conical surface 31 by the pressure of sealant in channel 41 and channel portion 43 reacting on the bottom of base 36.

The flow rate of the sealant is dependent upon such factors as viscosity of the sealant, pressure of supplied sealant, distances the bases 33 and 36 travel toward ledges 44 and 45, and the size and number of holes **32*a*. As long as either of valves 32 or 35 are actuated and held away from their respective conical surfaces 30 and 31, sealant will continue to flow; therefore, the quantity of sealant dispensed into the interior of valve cup 32 is varied or controlled by the time of depression or actuation of either of the valves 32 or 35**.

Thusly, it is now believed readily apparent that by use of the applicator of this invention, sealant can be applied to various size and length of fasteners immediately preceding their installation without necessitating a time delay for change of tooling to handle various length fasteners that is inherent in the prior art device.

It is to be understood that the foregoing disclosure is illustrative of the preferred embodiment of the invention. Various changes and modification so this embodiment will suggest themselves to those skilled in the art without departing from the true spirit and scope of the invention as set forth in the appended claims which alone define the true limitations of this invention.

What is claimed is:

1. A sealant applicator assembly for mounting on an automatic multi-length fastener installation machine including a movable fastener gripping and installation mechanism and an adjustable valve actuation means, said assembly comprising:

a body member having at least one bottom surface portion and at least one top surface portion;

a first and second passage means in said body member, each of which extends substantially vertically between said bottom and top surface portions;

a third passage means in said body member extending from said bottom surface to the exterior of said body member, said third passage means adapted to have a sealant supply connected thereto to deliver sealant to said third passage means;

the openings of said first, second and third passage means in the bottom surface of said body member being spaced whereby a portion of the bottom surface is located between each opening and the others;

a fourth passage means in said body member interconnecting said first passage means with said second passage means;

a base plate means mounted to the bottom surface of the body member, the area of the body member bottom surface confronted by said base plate means encompassing no less than the openings of the first, second and third passage means and the bottom surface portions therebetween;

a first valve means located within said first passage means which is actuable by the tip of the shank end of a fastener held by said fastener gripping and installation mechanism being forcibly inserted into said first passage means from the upper surface portion of the body member;

a second valve means located within said second passage means which is actuable by the valve actuation means of the fastener installation machine when the valve actuation means is in contact with said second valve means proximate the upper surface portion of the body member and there is relative approaching movement between the valve actuation means and said upper surface portion of the body member;

and a fifth passage means in said assembly interconnecting said first, second and third passage means whereby sealant may flow from the sealant supply to the fastener shank located in the first passage means by one of two flow paths depending upon the length of the fastener the sealant is to be applied to; the first flow path being sequentially from the sealant supply through the third passage means, the fifth passage and the first passage means when the length of the fastener is great enough to actuate said first valve means before said valve actuation means contacts said second valve means; and the second flow path being sequentially from the sealant supply through the third passage means, the fifth passage means, the second passage means, the fourth passage means and the first passage means when the length of the fastener is not great enough to actuate said first valve means before said valve actuation means contacts and actuates said second valve means.

2. A sealant applicator assembly as claimed in claim 1 wherein:

said first valve means comprises a calathiform member having a plurality of sidewall openings therethrough and adapted to have limited vertical slideability in said first passage means whereby when said first valve means is depressed by a fastener, the sealant can flow from said fifth passage means through said sidewall openings into the interior of said calathiform member for contact with the fastener shank, and upon removal of the fastener from contact with the first valve means the first valve means is moved vertically upward to a closed position by the pressure of the sealant in said fifth passage means;

and said second valve means comprises an axially slideable shaft member and adapted to have limited slideability in said second passage means whereby when said second valve means is depressed by said valve actuation means, the sealant can flow from said fifth passage means through said fourth passage means and then through said sidewall openings into the interior of said calathiform member of said first valve means for contact with the shank of a fastener located spatically within said calathiform member, and upon removal of said valve actuation means from contact with said second valve means the second valve means is moved vertically upward to a closed position by the pressure of the sealant in said fifth passage means.

3. A sealant applicator assembly as claimed in claim 2 wherein:

the portions of said first and second passage means at the bottom surface of the body member are each chamfered to provide truncated conical surfaces;

the calathiform member of the first valve means has an enlarged base portion proximate the lower end thereof and sized to prevent passage past the truncated conical surface of said first passage means whereby the upward displacement of the first valve means in the first passage means by the pressure of the sealant is limited upon removal of a fastener from contact with the first valve means;

and, the axially slideable shaft member of the second valve means has an enlarged base portion proximate the lower end thereof and sized to prevent passage past the truncated conical surface of said second passage means whereby the upward displacement of the second valve means in the second passage means by the pressure of the sealant is limited upon removal of the valve actuation means from contact with the second valve means.

4. A sealant applicator as claimed in claim 1 wherein the fifth passage means is a channel formed in the surface of the base plate means confronting the body member bottom surface.

* * * * *